US009520641B2

(12) United States Patent
Lin

(10) Patent No.: US 9,520,641 B2
(45) Date of Patent: Dec. 13, 2016

(54) ANTENNA ASSEMBLY AND ELECTRONIC DEVICE USING THE ANTENNA ASSEMBLY

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 508 days.

(21) Appl. No.: 14/014,633

(22) Filed: Aug. 30, 2013

(65) Prior Publication Data

US 2014/0313098 A1 Oct. 23, 2014

(30) Foreign Application Priority Data

Apr. 23, 2013 (TW) ..... 102114467 A

(51) Int. Cl.

| | |
|---|---|
| ***H01Q 1/24*** | (2006.01) |
| ***H01Q 9/42*** | (2006.01) |
| ***H01Q 5/378*** | (2015.01) |
| ***H01Q 5/392*** | (2015.01) |

(52) U.S. Cl.

CPC ..... *H01Q 1/243* (2013.01); *H01Q 5/378* (2015.01); *H01Q 5/392* (2015.01); *H01Q 9/42* (2013.01)

(58) Field of Classification Search

CPC ..... H01Q 1/234; H01Q 5/378; H01Q 5/392; H01Q 9/42

USPC ..... 343/700 MS, 702, 829, 846, 848

See application file for complete search history.

(56) References Cited

U.S. PATENT DOCUMENTS

| | | | | |
|---|---|---|---|---|
| 7,034,754 | B2 * | 4/2006 | Hung | H01Q 1/242 343/700 MS |
| 7,091,908 | B2 * | 8/2006 | Fabrega-Sanchez | H01Q 1/243 343/700 MS |
| 7,339,528 | B2 * | 3/2008 | Wang | H01Q 1/243 343/700 MS |
| 7,642,967 | B2 * | 1/2010 | Wang | H01Q 1/243 343/700 MS |
| 8,325,094 | B2 * | 12/2012 | Ayala Vazquez | H01Q 1/2258 343/700 MS |
| 8,587,486 | B2 * | 11/2013 | Chiu | H01Q 9/0421 343/702 |
| 8,698,673 | B2 * | 4/2014 | Wong | H01Q 1/2266 343/700 MS |
| 2008/0165063 | A1 * | 7/2008 | Schlub | H01Q 1/243 343/702 |

* cited by examiner

*Primary Examiner* — Tho G Phan
(74) *Attorney, Agent, or Firm* — Zhigang Ma

(57) ABSTRACT

An antenna assembly which can be adapted for the metal housing of any wireless device includes a feeding terminal, a first radiator connecting to the feeding terminal, a second radiator positioned parallel and adjacent to the first radiator, and a metal element connecting to the second radiator. The wireless signal fed to the first radiator can be coupled to the second radiator, and flows through the metal element to ground, thus utilizing the metal housing itself in the wireless transmission and reception process. An electronic device using the antenna assembly is also described.

13 Claims, 6 Drawing Sheets

ANTENNA ASSEMBLY AND ELECTRONIC DEVICE USING THE ANTENNA ASSEMBLY

CROSS-REFERENCE TO RELATED APPLICATIONS

This application is related to co-pending U.S. patent application Ser. No. 14/014,641 entitled "ANTENNA ASSEMBLY INTEGRAL WITH METAL HOUSING AND ELECTRONIC DEVICE USING THE ANTENNA ASSEMBLY". Such application has the same assignee as the present application. The above-identified applications are incorporated herein by reference.

BACKGROUND

1. Technical Field

The present disclosure relates to antenna assemblies, especially to an antenna assembly coupled with metal housing and an electronic device using the antenna assembly.

2. Description of Related Art

Electronic devices having metal housings are popular since the metal housings have high strength, high heat dissipation, and attractive appearance. However, metal housings are prone to interfere with wireless signals to or from antennas.

Therefore, there is room for improvement within the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
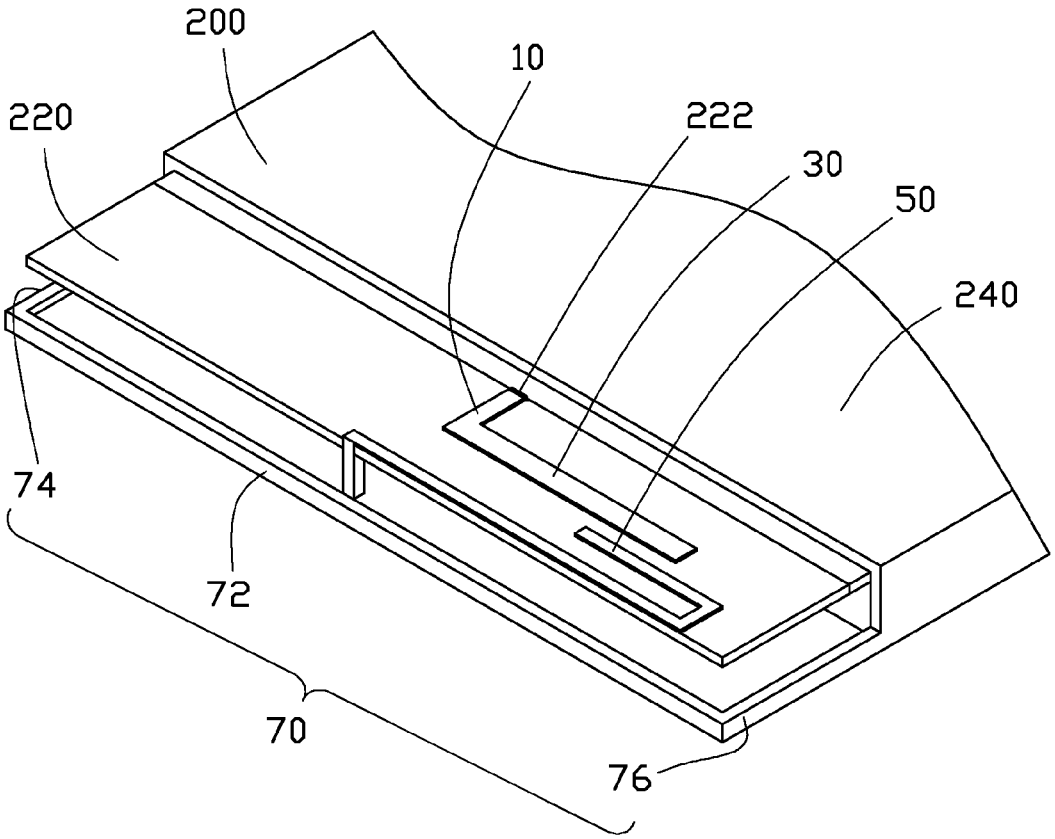
FIG. 1 is an isometric view of an electronic device having an antenna assembly in accordance with a first exemplary embodiment.
Figure 2:
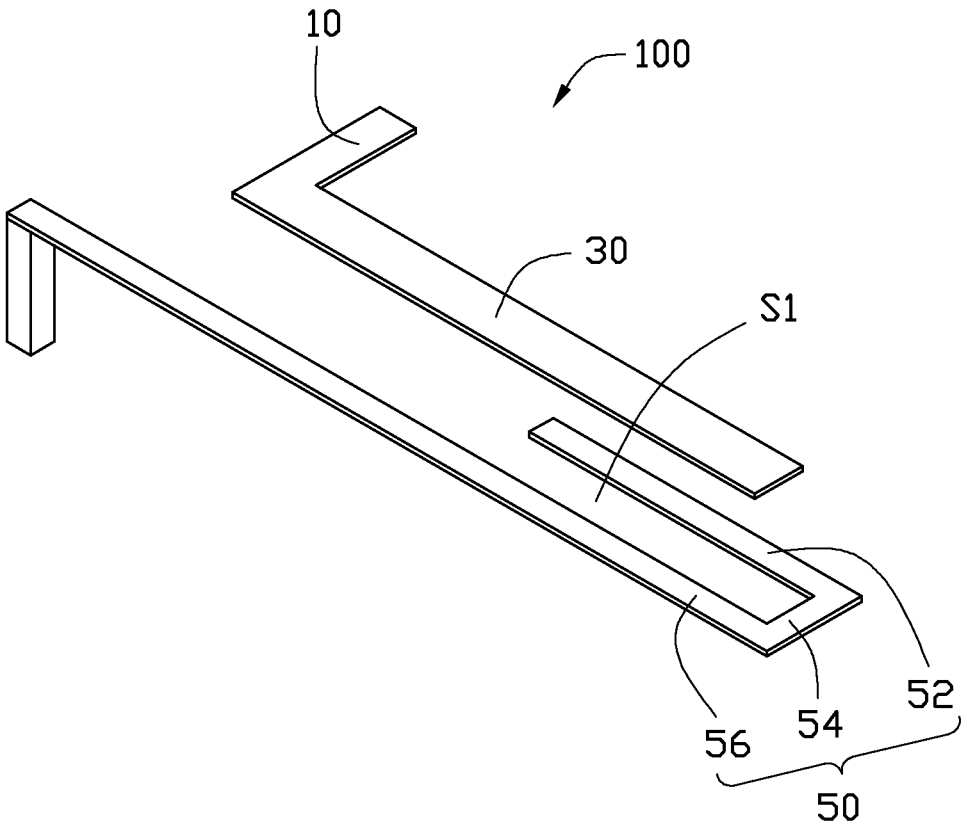
FIG. 2 is an isometric view of a portion of the antenna assembly of FIG. 1.

FIGS. 1-2 show an antenna assembly 100 which is used in an electronic device 200. The electronic device 200 may be a mobile phone, a panel computer, or a radio communication device, for example.

The electronic device 200 includes a circuit board 220 and a metal housing 240. The circuit board 220 defines a feeding point 222, through which the circuit board 220 feeds electrical signals to the antenna assembly 100, and a grounding point (not shown). The circuit board 220 is received in the metal housing 240, with the grounding point connected to the metal housing 240 by screws. A plastic antenna cover (not shown) to match the metal housing 240 can be provided to cover the circuit board 220 and the antenna assembly 100.

According to a first exemplary embodiment, the antenna assembly 100 includes a feeding terminal 10, a first radiator 30, a second radiator 50, and a metal element 70. The feeding terminal 10 is positioned on the circuit board 220, and electrically connects to the feeding point 222. The second radiator 50 connects to the metal element 70. The metal element 70 may be integrally formed with the metal housing 240.

The first radiator 30 is substantially perpendicularly connected to the feeding terminal 10, and on a same plane as the feeding terminal 10 and the second radiator 5. In the exemplary embodiment, the size of the first radiator 30 is capable of receiving/sending signals having a first bandwidth of between about 1630 MHz to about 2170 MHz.

The second radiator 50 includes a first radiator sheet 52, a second radiator sheet 54, and a third radiator sheet 56. The first radiator sheet 52 is parallel and adjacent to the first radiator 30, thereby the electrical signals of the first radiator 30 can be coupled to the second radiator 50. The second radiator sheet 54 substantially perpendicularly connects to the first radiator sheet 52 and the third radiator sheet 56. The third radiator sheet 56 extends towards the feeding terminal 10, and defines a first slot Si together with the first radiator sheet 52 and second radiator sheet 54. The length of the third radiator sheet 56 is longer than the length of the first radiator sheet 52.

The metal element 70 is metal and part of the metal housing 240. The metal element 70 includes a first frame 72, a second frame 74 connecting to one end of the first frame 72, and a third frame 76 connecting to the other end of the first frame 72. The first frame 72 contacts the third radiator sheet 56 of the second radiator 50 at the middle portion of the first frame 72. The sizes of the second radiator 50, the metal element 70, and the first slot S1 are capable of receiving/sending signals having a second bandwidth of between about 820 MHz to about 960 MHz.

Figure 3:
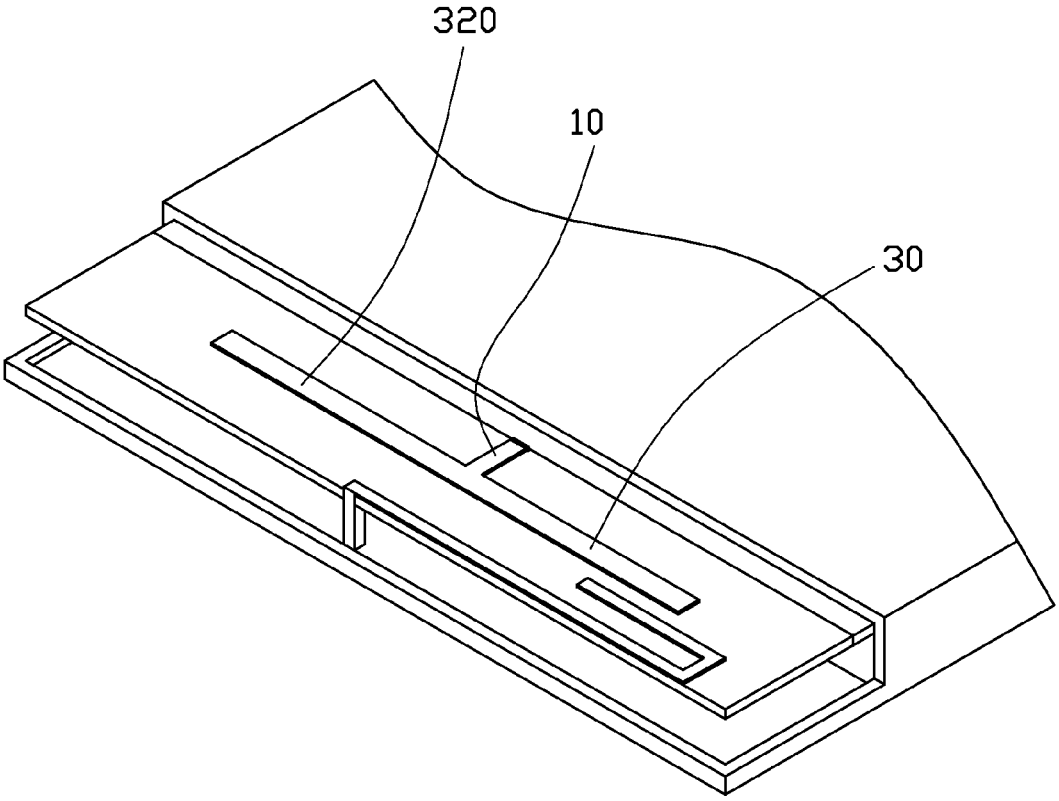
FIG. 3 is an isometric view of an electronic device in accordance with a second exemplary embodiment.

Referring to FIG. 3, in a second exemplary embodiment, an extending terminal 320 extends from the first radiator 30 and is located at a same plane as and in line with the first radiator 30. The extending terminal 320 also substantially perpendicularly connects to the feeding terminal 10. The extending terminal 320 increases the signal feed path of the feeding terminal 10, and improves the high frequency bandwidth of the antenna assembly 100.

Figure 4:
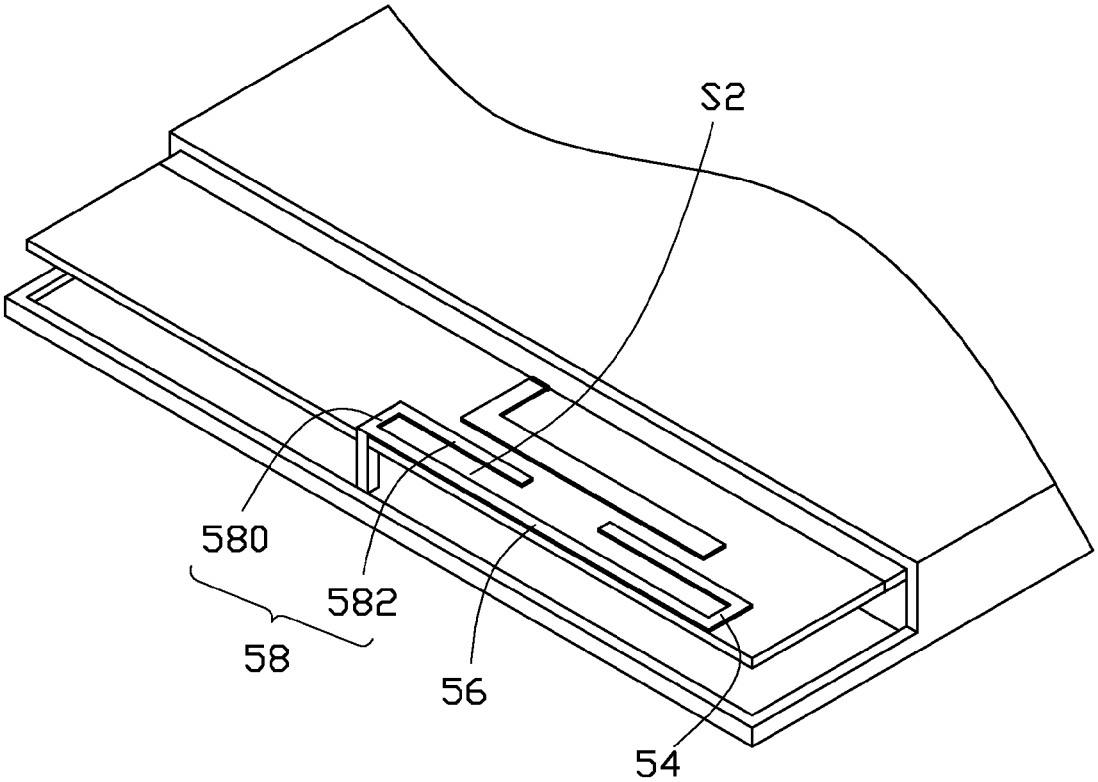
FIG. 4 is an isometric view of an electronic device in accordance with a third exemplary embodiment.

Referring to FIG. 4, in a third exemplary embodiment, an extending sheet 58 is formed to extend the third radiator sheet 56, for adjusting the signal path of the second radiator 50 and to enhance the low frequency bandwidth of the antenna assembly 100. The extending sheet 58 includes a first extending sheet 580 and a second extending sheet 582. The first extending sheet 580 substantially perpendicularly connects to the third radiator sheet 56 and the second extending sheet 582. The second extending sheet 582 substantially perpendicularly extends from the first extending sheet 580 towards the first radiator sheet 52, and defines a second slot S2 together with the first extending sheet 580 and the second radiator sheet 56.

Figure 5:
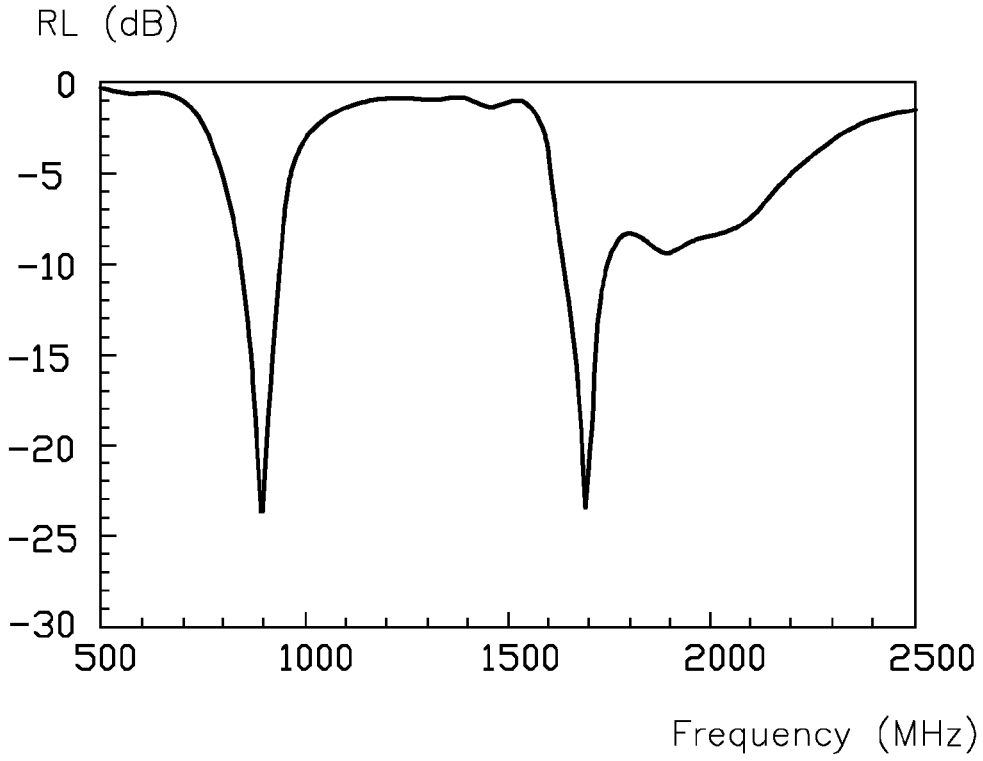
FIG. 5 is a return loss diagram for the antenna assembly of FIG. 1.
Figure 6:
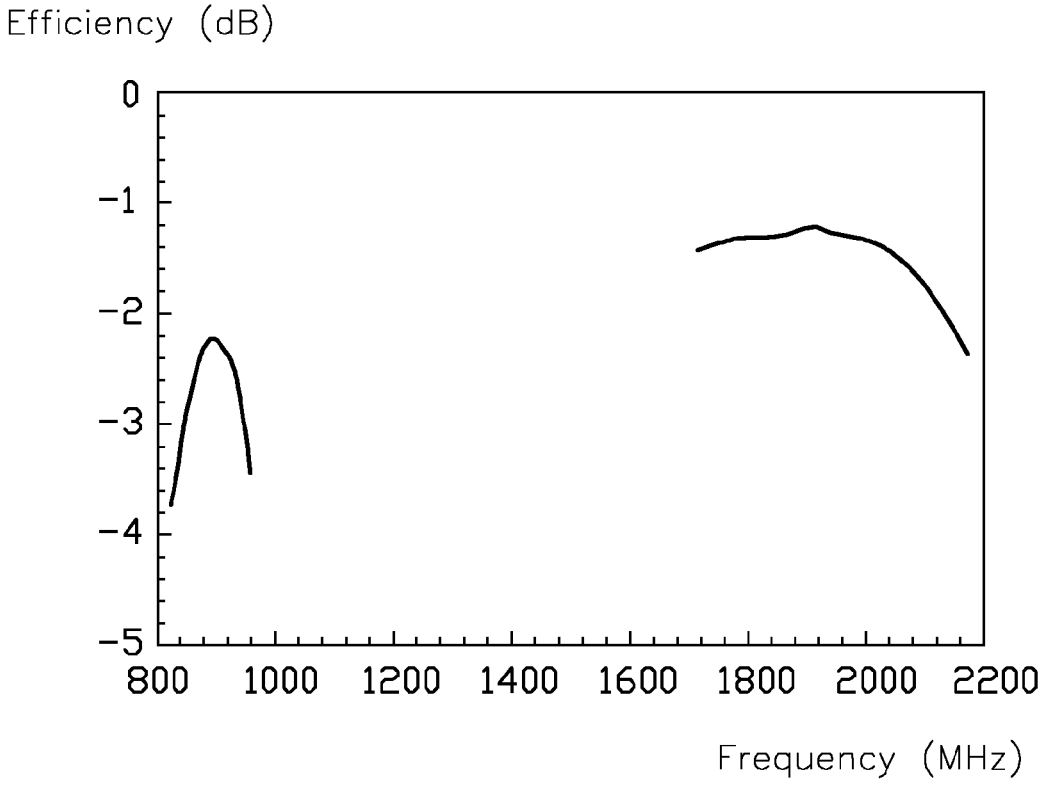
FIG. 6 is a receiving/sending efficiency diagram for the antenna assembly of FIG. 1.

When the feeding terminal 10 passes electrical signals from the electronic device 200, the electricity flows through the first radiator 30 to excite a first mode to receive/send a first signal. Since the first radiator sheet 52 is parallel and adjacent to the first radiator 30, the electricity of the first radiator 30 is coupled to the second radiator 50 and flows through the metal element 70 and then to ground via the metal housing 240, allowing a second mode to be excited to receive/send a second signal. FIG. 5 shows that the antenna assembly 100 has a low return loss at a first bandwidth between about 1630 MHz to about 2170 MHz and a second bandwidth between about 820 MHz to about 960 MHz. FIG. 6 shows that the antenna assembly 100 has a high efficiency in receiving/sending the signals having the first bandwidth between about 1630 MHz to about 2170 MHz and the second bandwidth between about 820 MHz to about 960 MHz.

The exemplary antenna assembly 100 couples the metal element 70 of the electronic device 200, which avoids the need to shield the metal housing 240, or shield against the metal housing 240, as well as reducing the size of the antenna assembly 100. Further, the antenna assembly 100 can adapt to the structure of the metal housing 240, that is, the structure of the metal housing 240 does not require to be changed to suit the antenna assembly 100, thus reducing the cost of the electronic device 200.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. An antenna assembly, comprising:

a feeding terminal;

a first radiator perpendicularly connecting to the feeding terminal;

a second radiator positioned on a same plane as the first radiator, and adjacent to the first radiator, allowing the electrical signals of the first radiator to couple to the second radiator; and a metal element connecting to the second radiator;

wherein the second radiator comprises a first radiator sheet, a second radiator sheet connecting to the first radiator sheet, and a third radiator sheet connecting to the second radiator sheet, the first radiator sheet is parallel and adjacent to the first radiator.

2. The antenna assembly as claimed in claim 1, wherein the second radiator sheet perpendicularly connects to the first radiator sheet and the third radiator sheet, the third radiator sheet extends towards the feeding terminal to define a first slot together with the first and second radiator sheets.

3. The antenna assembly as claimed in claim 2, wherein an extending sheet is formed to extend the third radiator sheet to adjust the signal path of the second radiator and enhance the low frequency bandwidth of the antenna assembly.

4. The antenna assembly as claimed in claim 3, wherein the extending sheet comprises a first extending sheet and a second extending sheet, the first extending sheet perpendicularly connects to the second extending sheet and the third radiator sheet, the second extending sheet extends towards the second radiator sheet, the first extending sheet, the second extending sheet, and the third radiator sheet cooperate to define a second slot.

5. The antenna assembly as claimed in claim 1, wherein the antenna assembly further comprises an extending terminal extending away from the first radiator and the feeding terminal.

6. An electronic device, comprising:

a metal housing; and an antenna assembly, the antenna assembly comprising:

a feeding terminal;

a first radiator connecting to the feeding terminal;

a second radiator positioned on a same plane as the first radiator, and adjacent to the first radiator, allowing the electrical signals of the first radiator to couple to the second radiator; and a metal element connecting to the second radiator and the metal housing, the metal element being part of the metal housing.

7. The electronic device as claimed in claim 6, wherein the metal element is a part of the electronic device, the metal element comprises a first frame, a second frame connecting to one end of the first frame, and a third frame connecting to the other end of the first frame, the first frame contacts the second radiator.

8. The electronic device as claimed in claim 6, wherein the electronic device further comprises a circuit board received in the metal housing, the circuit board defines an grounding point, the metal housing is electrically connected to the circuit board by the grounding point, the circuit board feeds electrical signals to the first radiator by the feeding terminal, the electrical signals of the first radiator is coupled to the second radiator and flow through the metal element to ground via the metal housing.

9. The electronic device as claimed in claim 6, wherein the first radiator is perpendicularly connected to the feeding terminal, the second radiator comprises a first radiator sheet, a second radiator sheet connecting to the first radiator sheet, and a third radiator sheet connecting to the second radiator sheet, the first radiator sheet is parallel and adjacent to the first radiator.

10. The electronic device as claimed in claim 9, wherein the second radiator sheet perpendicularly connects to the first radiator sheet and the third radiator sheet, the third radiator sheet extends towards the feeding terminal to define a first slot together with the first and second radiator sheets.

11. The electronic device as claimed in claim 10, wherein an extending sheet is formed to extend the third radiator sheet to adjust the signal path of the second radiator and enhance the low frequency bandwidth of the antenna assembly.

12. The electronic device as claimed in claim 11, wherein the extending sheet comprises a first extending sheet and a second extending sheet, the first extending sheet perpendicularly connects to the second extending sheet and the third radiator sheet, the second extending sheet extends towards the second radiator sheet, the first extending sheet, the second extending sheet, and the third radiator sheet cooperate to define a second slot.

13. The electronic device as claimed in claim 10, wherein the antenna assembly further comprises an extending terminal extending away from the first radiator and the feeding terminal.

* * * * *